US006648748B1

(12) United States Patent
Ferlin

(10) Patent No.: US 6,648,748 B1
(45) Date of Patent: Nov. 18, 2003

(54) VACUUM CONDUIT SYSTEM FOR REMOVAL OF FUMES AND AIR BORNE PARTICULATE MATTER

(76) Inventor: Keith Ferlin, R.R.#1, Suite 25, Comp. 30, Summerland British Columbia (CA), V0H 1Z0

( * ) Notice: Subject to any disclaimer, the term of this patent is extended or adjusted under 35 U.S.C. 154(b) by 0 days.

(21) Appl. No.: 10/166,083

(22) Filed: Jun. 11, 2002

(51) Int. Cl.[7] ..... B08B 15/00
(52) U.S. Cl. ..... 454/67; 454/65
(58) Field of Search ..... 454/63, 64, 65, 454/67, 345

(56) References Cited

U.S. PATENT DOCUMENTS

| | | | | |
|---|---|---|---|---|
| 1,390,950 A | * | 9/1921 | Avery | 104/52 |
| 1,676,969 A | * | 7/1928 | Sutton et al. | 209/502 |
| 2,939,378 A | * | 6/1960 | Zalkind | 454/63 |
| 3,200,765 A | * | 8/1965 | Ambli | 104/52 |
| 3,435,752 A | * | 4/1969 | Capstran | 454/64 |
| 4,540,202 A | | 9/1985 | Amphoux et al. | |
| 4,573,715 A | * | 3/1986 | Armbruster | 285/94 |
| 4,860,644 A | | 8/1989 | Kohl et al. | |
| 5,160,292 A | | 11/1992 | Parker | |
| 5,336,130 A | | 8/1994 | Ray | |
| 5,427,569 A | | 6/1995 | Plymoth | |
| 5,482,505 A | | 1/1996 | Hedlund | |
| 5,527,217 A | | 6/1996 | Engstrom | |
| 5,536,206 A | | 7/1996 | Bodmer et al. | |
| 5,738,148 A | | 4/1998 | Coral et al. | |
| 6,322,618 B1 | | 11/2001 | Simms et al. | |

FOREIGN PATENT DOCUMENTS

| | | | | |
|---|---|---|---|---|
| GB | 288798 | * | 4/1928 | 454/63 |

OTHER PUBLICATIONS

Ventaire, Inc., "Welding Exhaust Systems," and Ventaire, Inc., "Ventilation Systems for Noxious Fumes and Gases," www.ventaire.com/system_design_information.htm.

* cited by examiner

*Primary Examiner*—Harold Joyce
(74) *Attorney, Agent, or Firm*—Antony C. Edwards

(57) ABSTRACT

A vacuum conduit system for removal of fumes and air borne particulate matter includes a primary duct and a plurality of flexible secondary ducts mounted in fluid cooperation to the primary duct. The primary duct includes hollow rigid conduit sections interspersed between, and in fluid communication with, hollow flexible conduit sections. An upstream end of the primary duct is sealed substantially air-tight. An opposite downstream end of the primary duct cooperates with an air extraction means for extracting air from the primary duct. Secondary ducts may be mounted at their downstream ends to the rigid conduit sections and inclined at a first angle relative to the rigid conduit sections so that secondary airflows leaving the downstream ends of the secondary ducts are inclined into an airflow stream in the primary duct so as to be directed in a downstream direction of the airflow stream in the primary duct to generally equalize vacuum levels at the downstream ends of the secondary ducts.

15 Claims, 5 Drawing Sheets

12
A
59
13
13a
13b
58
58a
58b
58c
58d
56
54
14a
52
50
14
17
46
44
16c
E
α
B
48
48a
16b
16
40
16a
41
18
D

VACUUM CONDUIT SYSTEM FOR REMOVAL OF FUMES AND AIR BORNE PARTICULATE MATTER

FIELD OF THE INVENTION

This invention relates to the field of vacuum systems and in particular to an airborne particulate removal apparatus having a main flexible conduit in fluid communication with a plurality of flexible secondary conduits rotatably mounted to the primary conduit.

BACKGROUND OF THE INVENTION

As stated by Parker in U.S. Pat. No. 5,160,292 which issued Nov. 3, 1992 for A Vacuum System for Multiple Work Areas, many industries use equipment which in operation generates atmospheric contaminants, which might be gases or airborne particles. These gases and particles are sometimes a health hazard to the operator, as well as to other employees and the environment in general. This problem is especially acute in industrial operations such as woodworking or painting, where dust and gases that are harmful if inhaled are generated in close proximity to the worker. Additionally, particulates can eventually build up and damage equipment in the work area, and often require regular cleaning of the work area. Government regulations in many instances now strictly regulate the amount of such gases and particles which can be present in or emitted from the work area.

Vacuum systems have been installed to withdraw airborne contaminants generated in such work areas. A single vacuum source is usually provided. A manifold usually communicates between the vacuum source and a number of vacuum conduits, the conduits extending to individual work areas. Vacuum openings in the vacuum conduits are provided at the work areas to permit the withdrawal of air from the work area. The gases and particles in the air are thereby removed, and subsequent filtration or other cleansing operations can be employed downstream to permit subsequent disposal of the contaminants. A hood can be provided in association with each vacuum conduit and vacuum opening to reduce the amount of particles and gases that escape from the work area.

As disclosed in U.S. Pat. No. 6,322,618 which issued Nov. 27, 2001 to Simms et al. for An Adjustable Duct Assembly for Fume and Dust Removal and Filter Cleaner, an adjustable duct assembly for the collection of fumes, dust and the like may include two duct sections connected end-to-end by a duct support system which includes two elongate arms pivotally connected, the arms attached to the adjacent ends of the ducts. Similarly, applicant is aware of U.S. Pat. No. 5,482,505 which issued Jan. 9, 1996 to Hedlund for An Arrangement for Extraction of Harmful Gases from Workplaces in which is disclosed a carrier arm having two arms connected telescopically with each other where the carrier is swivel mounted so that it can be swivelled in a vertical direction between a downward-directed position and an outward-directed for example horizontal position. Similarly also, applicant is aware of U.S. Pat. No. 5,738,148 which issued Apr. 14, 1998 to Coral et al. for a Universal Connector Hose for Joining an Extractor to an Element for Extracting Fumes from a Factory Workplace in which is disclosed a hose having two flexible portions connected respectively to the suction unit and to the fume-conveyor element or hood and a rectilinear portion which is articulated to the suction unit and the hood. Other articulated fume extraction arms of which applicant is aware are described in the following U.S. Pat. Nos. 4,540,202; 5,427,569; 5,527,217; 5,536,206; 4,860,644; and 5,336,130.

What is neither taught nor suggested in the prior art, and what is one of the objects of the present invention to provide, is a constant diameter modular ducting having a cable suspension system and which is, when compared to the prior art, easy to erect, and which may be a low static compressed air driven fan system providing multiplexing capabilities of, for example, five hose airstreams to one primary hub having a single low pressure source such as a central exhaust fan. The flex hose design of the present invention provides suction outlets which may optimize fume extraction with minimal repositioning and which, at the other end of the flex hoses, are provided with hose-to-main duct fittings which minimize static pressure drop and equalize flow in multiple flex hose arms.

SUMMARY OF THE INVENTION

In one embodiment of the present invention, a main or primary flexible duct has alternating flexible sections and rigid sections, providing a duct of substantially constant sixteen inch diameter. Prefabricated hose connection pieces provide for rapid assembly using releasable hose clamps to modularly secure the modular sections of the primary ducting to each other. Advantageously, the primary duct is tubular. The ducting provides maximum versatility in conforming to a round, square or rectangular work space or may be extended in a straight line. Equal exhaust flow from each of a plurality of flexible secondary hoses, that is, the hose arms or legs, which may be four inch diameter hoses, branching from the primary duct is promoted by static pressure optimization of the flow from the secondary hoses through flow optimizing fittings, which may in a preferred embodiment be diffuser fittings having a four to six inch diameter feeding into a sixteen inch primary duct, where the diffuser fittings incline the flow from the secondary hoses in the direction of flow through the primary ducting.

A fan housing has external loops, which permit a cable attachment to the nearby first wall of a building. At the opposite end of the run of primary ducting, an end cap has a bar, which extends outwardly of the cap to allow a cable yoke to be attached. A tensioning/supporting cable is attached to the yoke, passes around pulleys attached to the opposite second end of the building and returns to an anchoring point at the first wall. A tensioning device is provided near the second wall for applying or relieving tension on the tensioning/supporting cable.

The flex sections of the primary ducting are connected to the rigid sections (so-called hard bodied sections) by flexible couplers secured by a pair of annular clamps. One end of the flexible coupler is mounted to the hard body section by a clamp having double annular bead receiving grooves or channels each tensionable by its own latch. By partially releasing one of the latches, for example the latch adjacent to the hard body section, the flexible section is still held securely by the flexible coupler, but the hard body section may be rotated about its longitudinal axis relative to the flexible coupler and then re-clamped into its desired orientation.

A frusto-conical diffuser is mounted to the inclined base of the diffuser fitting and secured by a double bead receiving clamp. The inclined base is mounted over an aperture in the hard body section. A section of secondary hose is mounted to the diffuser by another flexible coupler. A vacuum head may be secured at the anterior end of the secondary hose by a connector such as another flexible connector or coupler.

The removable thirty degree base of the diffuser fitting has a rigid base flange having a resilient under-gasket in contact with the hard body section. It is secured to the hard body section by a clamp passing around the hard body section. Upstream of the aperture in the hard body section is a locking member while downstream is an upstanding gusset, which is aligned with a corresponding slot in base flange of the fitting. The gusset has an aperture, which will accept a clip to retain the fitting snugly in place. The gusset prohibits rotation of the fitting on the hard body section during closure of retaining clamp. The retaining clip also has a ground wire to eliminate static electricity build-up.

The helically wrapped wire in the large diameter flex hose of the flexible section of the primary ducting is exposed near the hard body section. Static electricity build up may be eliminated by bringing the wire in contact with the clamp on the hard body section or by clipping a ground wire to it.

A length of flexible cable joins each hard body section, and is connected between rigid connection bars secured to the inner surface near each of the ends. The cables prohibit over-extension of each flexible section along the vacuum manifold provided by the primary ducting.

For use in localized general ventilation and localized exhaust ventilation, the vacuum conduit system for removal of fumes and air borne particulate matter according to the present invention may be summarized as including a primary duct and a plurality of flexible secondary ducts mounted in fluid cooperation to the primary duct. The primary duct includes hollow rigid conduit sections interspersed between, and in fluid communication with, hollow flexible conduit sections. An upstream end of the primary duct is sealed substantially air-tight. An opposite downstream end of the primary duct cooperates with an air extraction means for extracting air from the primary duct so that the primary duct functions as a vacuum manifold. Secondary ducts may be mounted at their downstream ends to the rigid conduit sections and inclined at an inclined angle relative to the rigid conduit sections so that secondary airflows leaving the downstream ends of the secondary ducts are inclined into an airflow stream in the primary duct so as to be directed in a downstream direction of the airflow stream in the primary duct. It is an object to generally equalize vacuum levels at the downstream ends of the secondary ducts.

The secondary ducts may be short fittings or just localized capture apertures for localized general ventilation, or may include long flexible hoses for localized exhaust ventilation. The primary duct has a constant first diameter and the secondary duct has a second diameter. The first and second diameters preferably form a ratio of greater than two. The ratio may be 16:6 or 16:4, or may be in the range of 16:4 to 16:6. The inclined angle may be substantially thirty degrees.

The rigid section may be cylindrical and the secondary duct may be mounted thereto by means of a generally cylindrical diffuser fitting inclined at the inclined angle in the downstream direction of the airflow stream in the primary duct. The diffuser fitting has a downstream aperture and the rigid section has an aperture in a wall thereof, so that the downstream aperture of the diffuser fitting mates and seals over the aperture in the wall of the rigid section. The diffuser fitting may include a conical frustum mounted at a narrow end thereof to the downstream end of the secondary duct. A cylindrical section of the fitting is mounted to the wider opposite end of the conical frustum. The aperture in the wall of the rigid section may be pyriform so as to have a narrower end and an opposite broader end, wherein the narrower end is upstream of the broader end along the airflow stream in the primary duct. The rigid section may include a rotatable section selectively rotatably mounted by cuff mounting means between adjacent flexible sections so as to be selectively rotatable about a longitudinal axis of the airflow stream in the primary duct. Selectively releasable locking means may be provided for locking the rotatable section on the cuff mounting means relative to the flexible sections in an angular position so as to generally direct a corresponding secondary duct of the plurality of secondary ducts to a desired workspace.

The primary duct may include sections of flexible tube as the flexible conduit sections. Each secondary duct of the plurality of secondary ducts may be a flexible hose. A vacuum head may be mounted at the upstream-most end of each of the secondary ducts. A cable suspension means may be provided for suspending the primary duct under a cable of the cable suspension means, wherein the cable is mountable, and releasably tensionable by tensioning means, between rigid supporting surfaces.

DETAILED DESCRIPTION OF EMBODIMENTS OF THE INVENTION

Figure 1:
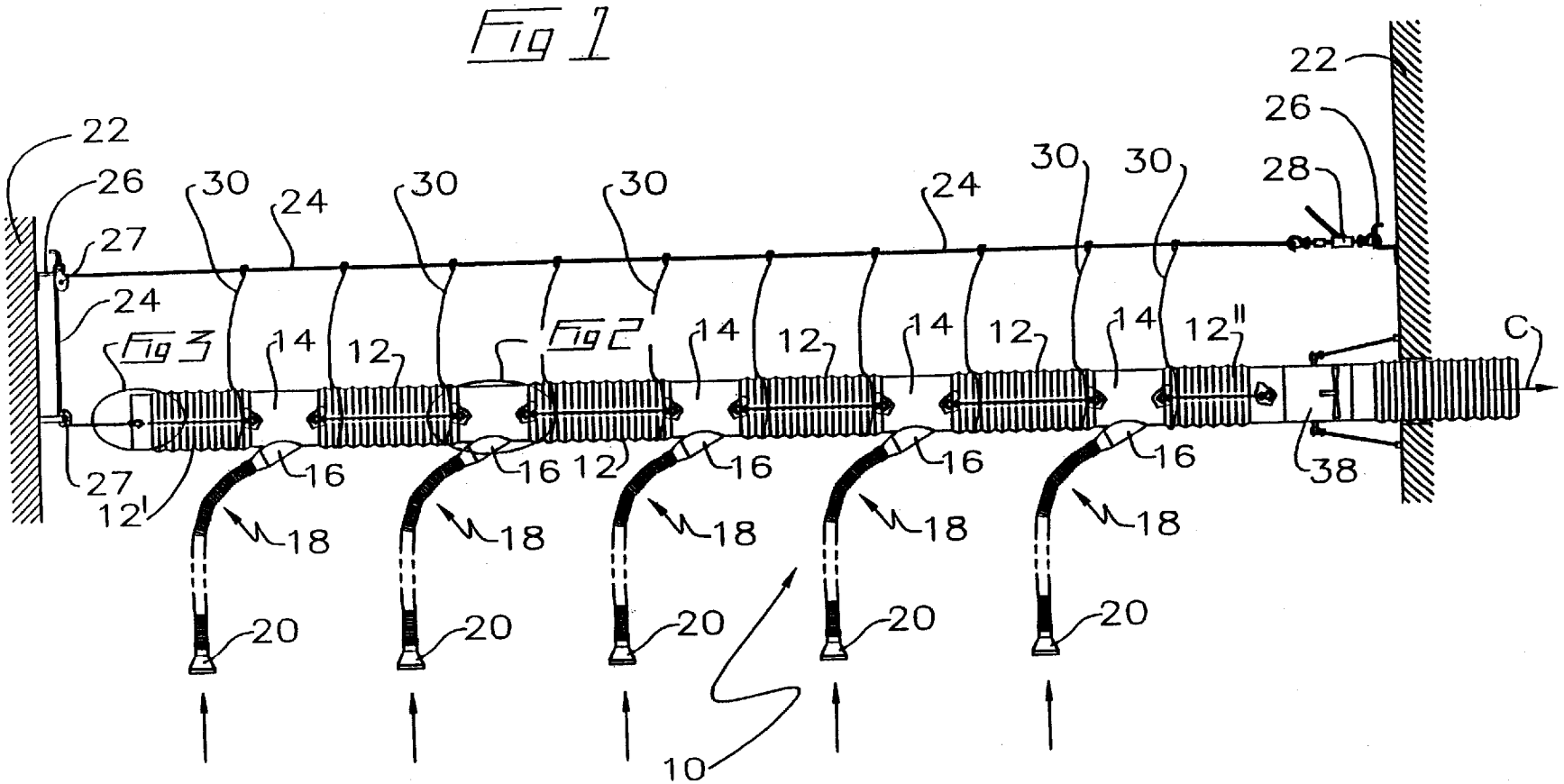
FIG. 1 is, in side elevation view, the vacuum conduit system of the present invention in an embodiment suspended from a cable.
Figure 2:
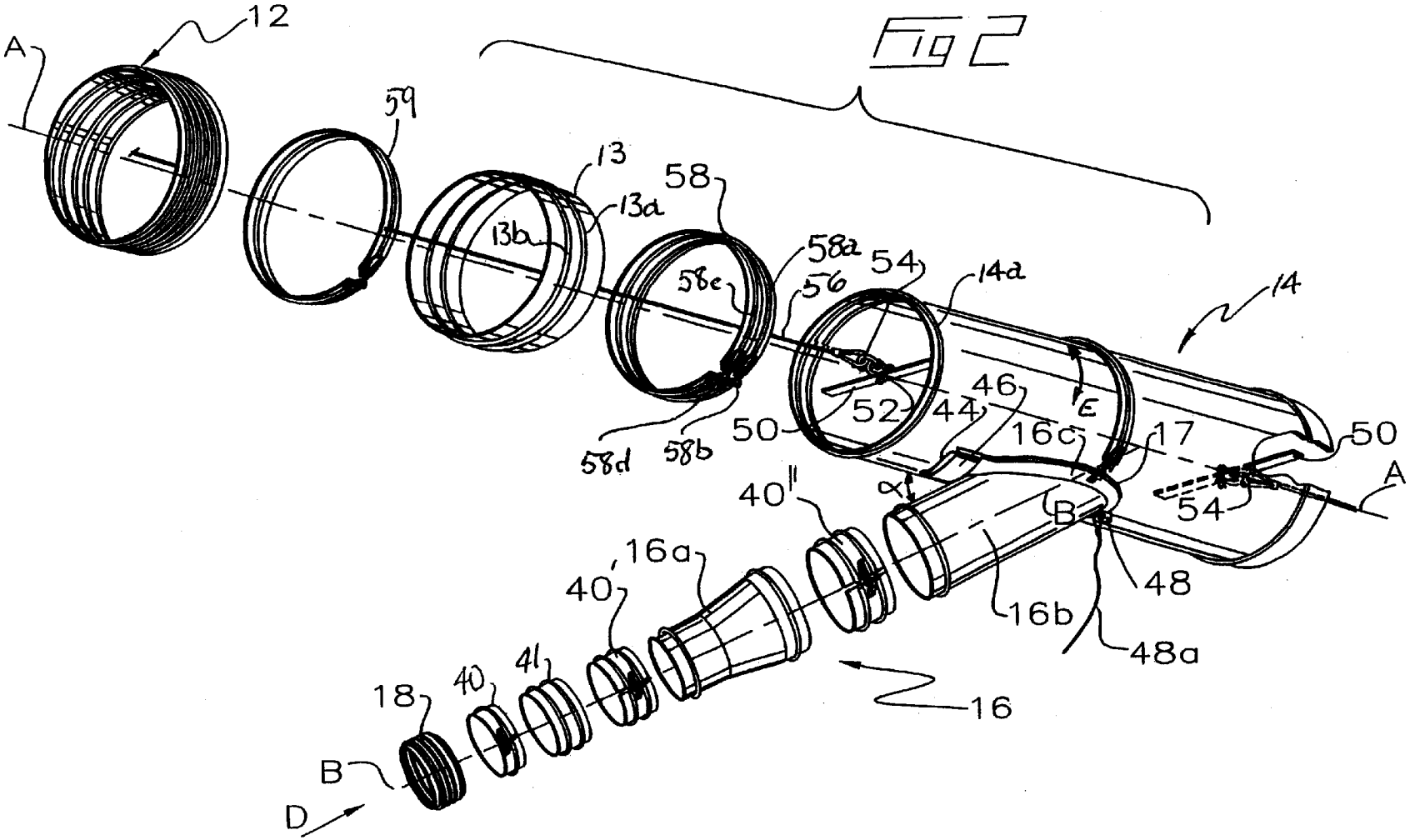
FIG. 2 is, in partially exploded partially cut away perspective view, a hard body section of the vacuum conduit system according to one embodiment of the present invention.
Figure 2A:
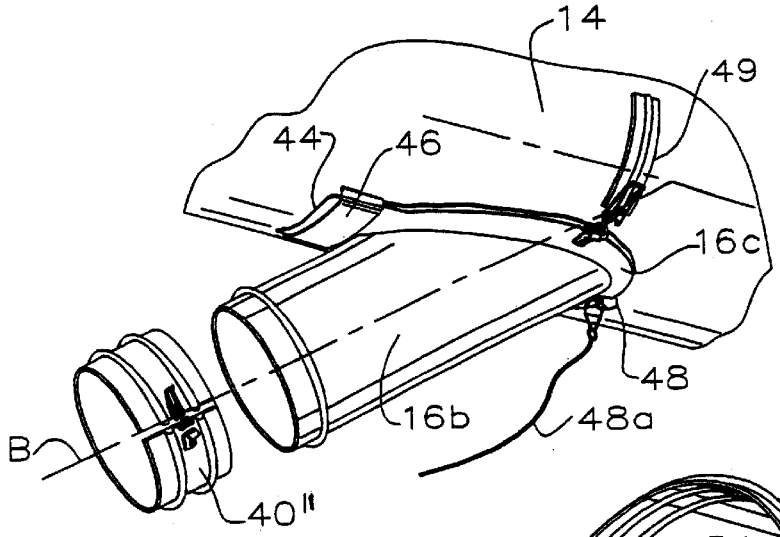
FIG. 2*a* is, in partially cut away partially exploded view, the mounting of the secondary conduit fitting onto the primary conduit hard body section of FIG. 2.
Figure 2B:
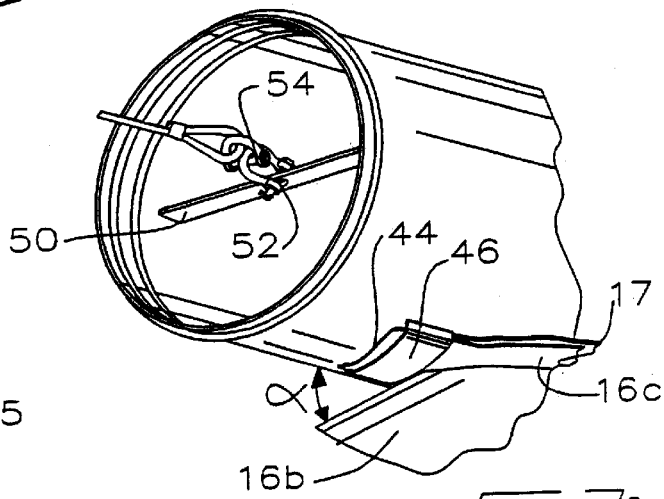
FIG. 2*b* is, in partially cut away view, the cable mounted onto the rigid section to prevent overextension of the flexible section.

As seen in FIG. 1, the ducting system of the present invention includes a primary duct 10 which is modularly constructed of flexible sections 12 of sixteen inch diameter flexible hose, tube or conduit interspersed between hollow rigid sections 14 seen in better detail in FIGS. 2, 2*a* and 2*b*.

In the preferred embodiment, both flexible sections 12 and rigid sections 14 are substantially tubular so that, as better describe below, fittings 16 may be rotated about the longitudinal axes A of the rigid sections 14 to which they are releasably mounted.

Fittings 16 mount flexible secondary hoses 18 to the rigid sections 14 so as to dispose the longitudinal axes of symmetry B of fittings 16 to intersect longitudinal axis A to form an included angle a of substantially thirty degrees. Each secondary hose 18 may be in the order of twenty to twenty-five feet long and may have mounted at its distal or upstream end a vacuum head 20 as better seen in FIGS. 4 and 6 and described below.

Primary duct 10 may be suspended, for example, between two walls 22 by a cable 24 tensioned between anchors 26 mounted to walls 22. Cable 24 extends around pulley blocks 27 and is tensioned, releasably, by ratchet hoist 28. Suspension cables 30 may be mounted in spaced apart array along cable 24, each of suspension cables 30 mounted at one end to cable 24 and at their opposite ends to, for example, either end of adjacent rigid sections 14 so as to suspend primary duct 10 along the horizontal length of cable 24 extending, for example, parallel to cable 24.

Figure 3:
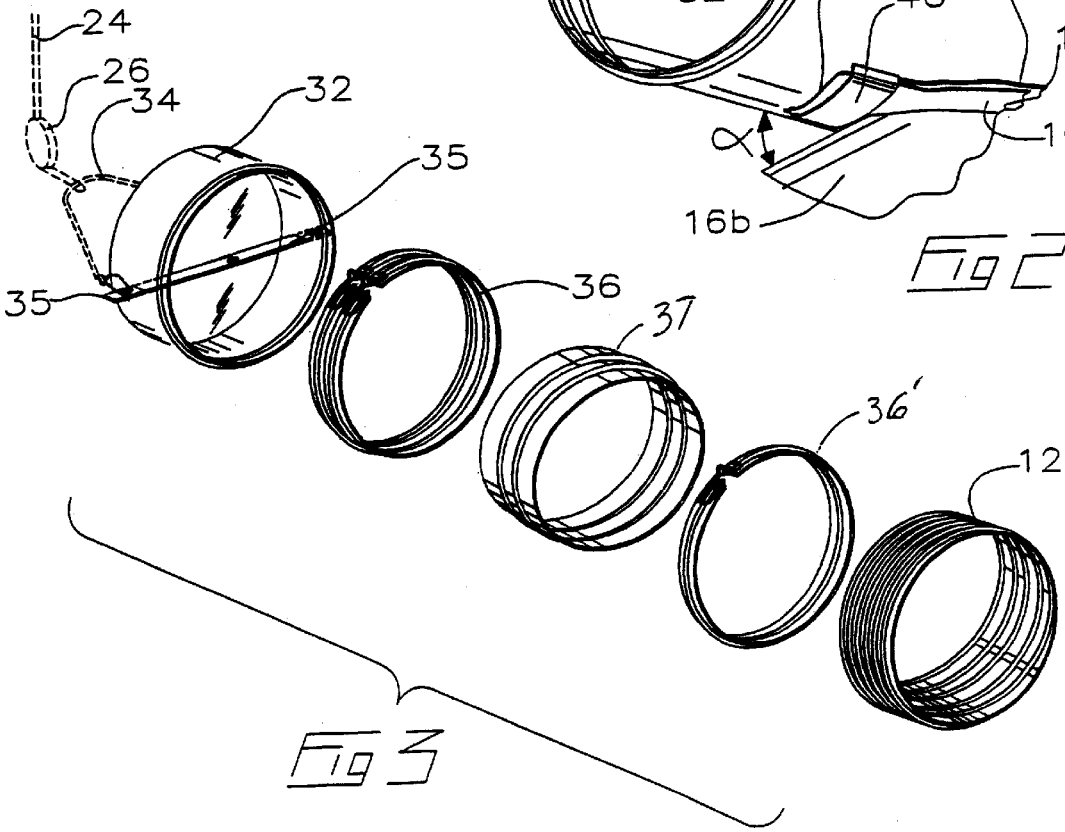
FIG. 3 is, in exploded perspective view, the upstream-most end of the primary duct of the vacuum conduit system according to one embodiment of the present invention.

The upstream-most end of primary duct 10 may be sealed off for example by means of an end cap 32 as better seen in FIG. 3. Cap 32 may be mounted either to a flexible section 12 or a rigid section 14. A cable yoke 34 may be mounted to a bar 35 on end cap 32 so as to provide for releasably mounting end cap 32 onto one end of cable 24. A double-bead receiving hose clamp 36 may be used to mount to a single annular bead on end cap 32 and to one of a pair of parallel annular beads on flexible coupler 37. A single-bead receiving hose clamp 36' mates onto the other annular bead on flexible coupler 37 so as to clamp thereon one end of, for example, a shorter first section 12' of flexible sections 12. The annular bead-receiving grooves on the hose clamp mate with the corresponding beads on the ends of the flexible couplers or rigid sections of duct.

Adjacent lengths of flexible sections 12 extending between adjacent rigid sections 14 may be of longer lengths. For example, adjacent longer sections 12 may be approximately twenty feet long as primary duct 10 spans the horizontal distance along cable 24. Thus in the illustrated embodiment, a single primary duct 10 has five rigid sections 14 supporting therefrom five corresponding secondary hoses 18 and sandwiching interposed therebetween four longer flexible sections 12. Extending downstream from the downstream-most rigid section 14 is a shorter section 12" of flexible sections 12. A compressed air fan 38, for example a 5100 CFM capacity fan may be mounted to the downstream-most end of shorter flexible section 12" so as to draw a flow of, for example, particulate laden air in through vacuum heads 20, and through the corresponding secondary hoses 18 and fittings 16 so as to be drawn into and along primary duct 10 in direction C, wherein each of the secondary hoses may account for approximately 300 CFM.

Figure 5:
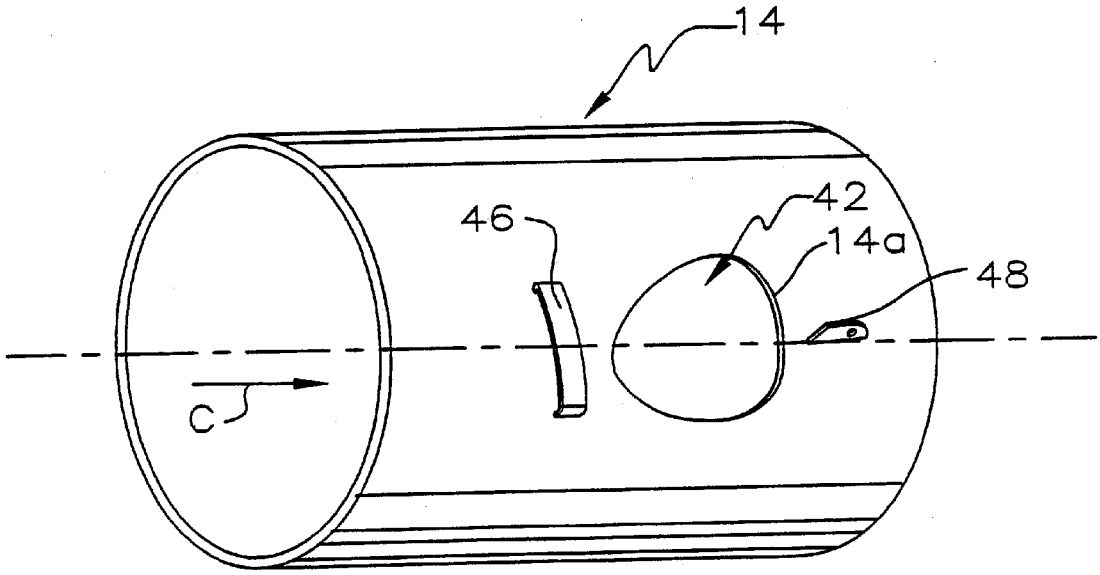
FIG. 5 is, in perspective view, the hard body section of FIG. 2 with the secondary conduit fitting removed.

The downstream ends of each secondary hose 18 is mounted by means of a single-bead receiving hose clamp 40 onto one of a pair of parallel beads on flexible couple 41. One bead-receiving groove on a double-bead receiving hose clamp 40' clamps onto the other bead on flexible coupler 41. The remaining bead-receiving groove on hose clamp 40' mounts to the narrower end of a frusto-conical diffuser fitting section **16*a*. The downstream end of coupler 41 may fit into the upstream end of section 16*a* is an overlapping fit to streamline flow. Diffuser fitting section 16*a* diffuses the flow leaving secondary hose 18 in direction D into a wider diameter cylindrical fitting section 16*b* which may have an inside diameter of six and one quarter inches. Section 16*a* may be mounted to section 16*b* by double-bead receiving hose clamp 40". As better seen in FIG. 5, the downstream end of fitting 16 mates onto an elliptical or egg-shaped or pear-shaped (collectively referred to herein as pyriform) aperture 42 formed in the wall of rigid section 14 so as to align the long axis of aperture 42 parallel to longitudinal axis A. Fitting 16 has a circumferential flange 16*c* mounted around or formed on section 16*b* so as to extend from the downstream-most end of fitting section 16*b*. Flange 16*c* is shaped so as to conformally snugly mate onto the rim 14*a* surrounding aperture 42 so as to sandwich a resilient gasket 17 therebetween. Flange 16*c* has a tongue 44 extending along rigid section 14 in the upstream direction of rigid section 14 when fitting 16 is mounted over aperture 42 so as to mate tongue 44 under curved locking member 46 mounted adjacent aperture 42 to the wall of rigid section 14**.

With tongue 44 releasably inserted between locking member 46 and the wall of rigid section 14, the opposite end of flange **16*c* may be releasably locked by locking a means so as to flush mount flange 16*c* against and around circumferential edge 14*a*. The locking means may for example be an upstanding gusset 48 on section 14 which aligns with a corresponding slot in flange 16*c*. The gusset has a hole in it sized to accept a clip. With the gusset slid through the slot so as to expose the hole, a clip may be used to lock the fitting into place. A releasable retaining band 49 secures the sides of flange 16*c* down onto rigid section 14. A ground wire 48*a* on clip 48** is used to ground static electricity build-up. The helically wrapped wire in the large diameter flex hose is exposed near the hard body. Static electricity build up may be eliminated by bringing the wire in contact with the clamp on the hard body or by clipping a ground wire to it.

As seen in FIG. 2, a clevis mounting member 50 is mounted across each end of a rigid section 14 so as to position a mounting aperture 52 centered along each member 50 on longitudinal axis A. Cables 56 extend between adjacent rigid sections 14 to prevent over-extension of flexible sections 12 when ducting 10 is tensioned. The cable is mounted to rigid sections 14 by swivelling clevis's 54. Clevis's 54 are looped through looped ends of the cable and bolted to apertures 52. The tension of cables 56 is adjusted to substantially remove the accordion corrugations in the flexible sections so as to reduce static pressure losses.

Double-bead receiving hose clamps 58 releasably secure the ends of flexible couplers 13 onto the ends of rigid sections 14. In particular, first bead receiving grooves **58*a* mate onto beads 14*a* and are tensioned thereon by latches 58*b*. Second bead receiving grooves 58*c* mate onto beads 13*a* and are tensioned thereon by latches 58*d*. Single-bead receiving clamps 59 mate onto beads 13*b* to clamp the end of flexible sections 12 thereon. By partially releasing one of the clamps, latches 58*b* or 58*d* to release tension on, for example, the clamping of grooves 58*a* onto beads 14*a* on the hard body sections, the ducting flexible sections 12 may still held securely but the hard body sections may be rotated about their longitudinal axes in direction E to provide for convenient orienting of fittings 16 and hoses 18**.

Figure 4:
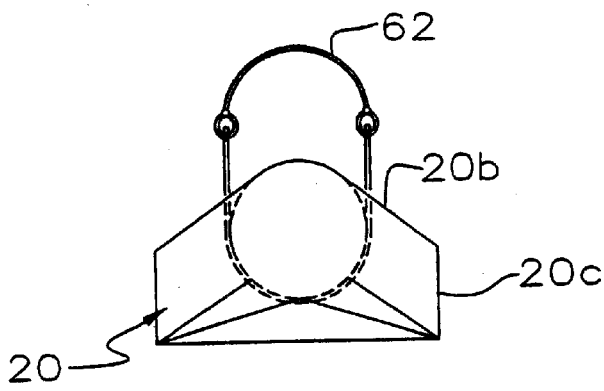
FIG. 4 is, partially cut away plan view, a vacuum head on a secondary duct of a vacuum conduit system according to one embodiment of the present invention.
Figure 6:
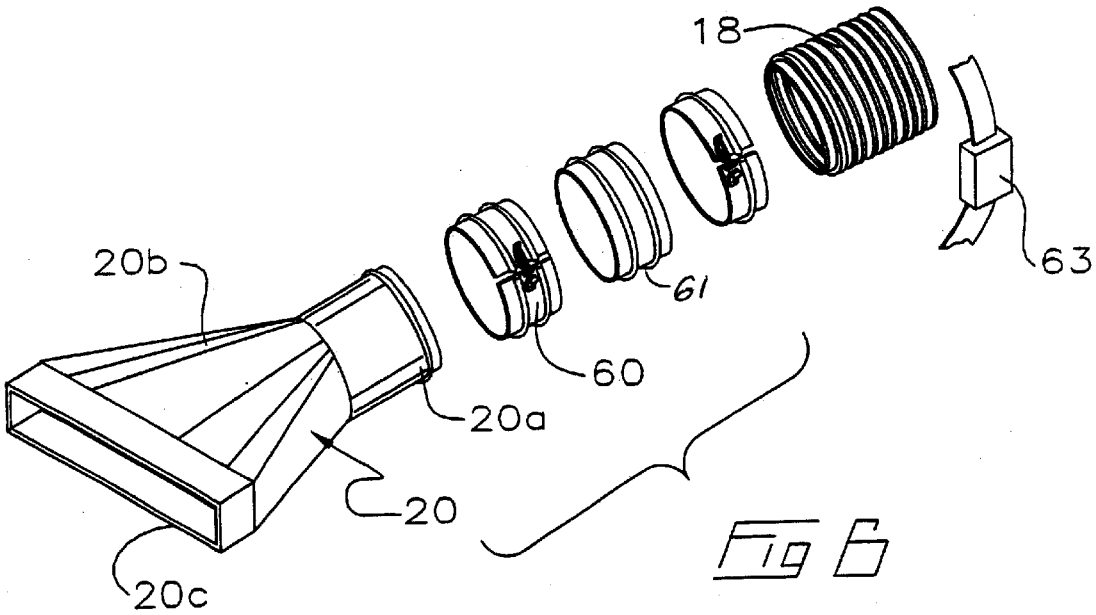
FIG. 6 is, in partially exploded perspective view, the vacuum head and flexible secondary duct of FIG. 4.

Similarly, as seen in FIG. 6, annular hose clamps 60 and 60' releasably mount, respectively, the rigid collar **20*a* of vacuum head 20 to one end of flexible coupler 61 and the other end of the flexible coupler to the upstream end of secondary hoses 18. A truncated-wedge shaped conduit 20*b* forms a venturi entryway into collar 20*a* from the upstream rectangular intake 20*c*. A magnet 63 may be mounted adjacent head 20 for releasable mounting the head to metal fixtures As seen in FIG. 4, a handle 62 which may be flexible, for example of rope, may be mounted to vacuum head 20 to provide for ease of positioning of the vacuum head on the distal upstream-most edge of flexible hoses 18**.

Figure 7:
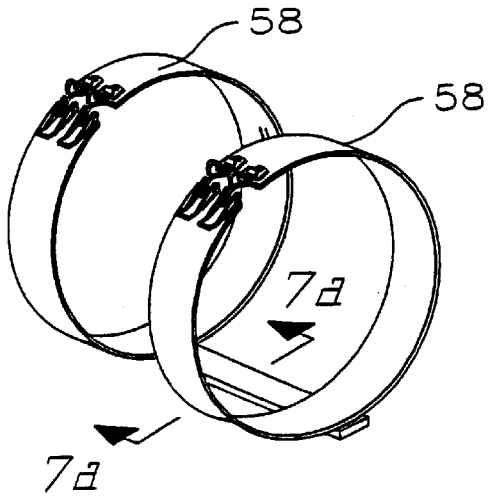
FIG. 7 is, in perspective view, an alternative embodiment fitting for mounting the flexible ducting according to the present invention onto existing rigid fixtures.
Figure 7A:
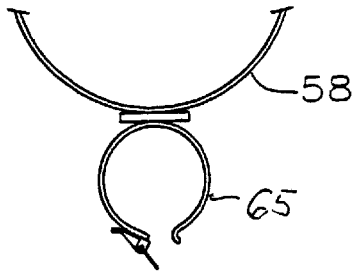
FIG. 7*a* is, in partially cut away elevation view, the mounting fixture of FIG. 7.

As seen in FIGS. 7 and **7*a*, a pair of clamps 58 may be welded to a bar. A further clamp 65 is mounted to the bar opposite clamps 58**. This arrangement provides for mounting a flexible section or hard body section to a structural component of a building.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A conduit system for movement of an airstream and air borne particulate matter comprising:

a primary duct, a plurality of flexible secondary ducts mounted in fluid cooperation to said primary duct, said primary duct including hollow rigid conduit sections interspersed between, and in fluid communication with, hollow flexible conduit sections, a first end of said primary duct sealed substantially air-tight, an opposite second end of said primary duct cooperating with an air extraction means for extracting air from said primary duct, said secondary ducts mounted at downstream ends thereof to said rigid sections and inclined at a first angle relative to said rigid conduit sections so that secondary airflows leaving said second ends of said secondary ducts are inclined at a first angle relative to an airflow stream in said primary duct so as to be directed in a downstream direction of said airflow stream in said primary duct to generally equalize vacuum levels at said second ends of said secondary ducts when said airflow stream is drawn along said primary duct so as to cause a vacuum in said primary duct, wherein said primary duct has a constant first diameter and wherein said secondary ducts have a second diameter, and wherein said first and second diameters form a first diameter: second diameter ratio of greater than two.

2. The device of claim 1 wherein said first angle is substantially thirty degrees.

3. The device of claim 1 wherein said ratio is 16:6.

4. The device of claim 1 wherein said ratio is 16:4.

5. The device of claim 1 wherein said ratio is substantially in the range of 16:4 to 16:6.

6. The device of claim 3 wherein said angle is substantially thirty degrees.

7. The device of claim 4 wherein said angle is substantially thirty degrees.

8. The device of claim 5 wherein said angle is substantially thirty degrees.

9. The device of claim 1 wherein said first end is an upstream end and wherein said second end is a downstream end and wherein said rigid section is cylindrical and said secondary duct is mounted thereto by means of a generally cylindrical diffuser fitting inclined at said angle in said downstream direction of said airflow stream in said primary duct, and wherein said diffuser fitting has a downstream aperture, and wherein said rigid section has an aperture in a wall thereof, said downstream aperture of said diffuser fitting, for mating and sealing, over said aperture in said wall of said rigid section.

10. The device of claim 9 wherein said aperture in said wall of said rigid section is pyriform so as to have a narrower end and an opposite broader end, wherein said narrower end is upstream of said broader end along said airflow stream in said primary duct.

11. The device of claim 9 wherein said rigid section includes a rotatable section selectively rotatably mounted between adjacent said flexible sections so as to be selectively rotatable about a longitudinal axis of said airflow stream in said primary duct.

12. The device of claim 11 wherein said rigid section includes selectively releasable locking means for locking said rotatable section relative to said flexible sections in an angular position so as to generally direct a corresponding secondary duct of said plurality of secondary ducts to a desired workspace.

13. The device of claim 11 wherein said primary duct includes a flexible tube and each secondary duct of said plurality of secondary ducts is a flexible hose, and wherein a vacuum head is mounted at the upstream-most end of each of said secondary ducts.

14. The device of claim 1 further comprising a cable suspension means for suspending said primary duct under a cable of said cable suspension means, said cable mountable, and releasably tensionable by tensioning means, between rigid supporting surfaces.

15. The device of claim 10 wherein said diffuser fitting includes a conical frustum mounted at a narrow end thereof to said downstream end of said secondary duct, a cylindrical section mounted to a wider end of said conical frustum.

* * * * *